United States Patent [19]

Kowal

[11] Patent Number: 4,932,104

[45] Date of Patent: Jun. 12, 1990

[54] SEPARABLE BUCKLE

[76] Inventor: Adolf Kowal, P.O. Box 65, 270 53 Gärsnäs, Sweden

[21] Appl. No.: 413,531

[22] Filed: Sep. 27, 1989

[30] Foreign Application Priority Data

Sep. 30, 1988 [SE] Sweden ..... 8803483
May 8, 1989 [SE] Sweden ..... 8901622

[51] Int. Cl.[5] ..... A44B 11/12

[52] U.S. Cl. ..... 24/170; 24/193; 24/197; 24/68 CD

[58] Field of Search ..... 24/170, 171, 193, 194, 24/197, 585, 614, 316, 310, 17 R, 24, 68 CD, 68 E, 68 F, 69 CT

[56] References Cited

U.S. PATENT DOCUMENTS

| | | | |
|---|---|---|---|
| 749,953 | 1/1904 | Sourek | 24/170 |
| 3,128,106 | 4/1964 | Binkel, Jr. | 24/68 CD |
| 3,277,543 | 10/1966 | Gaylord | 24/193 |
| 3,495,305 | 5/1966 | Mezerenyi . | |
| 3,566,454 | 3/1971 | Schmidt . | |
| 4,420,858 | 12/1983 | Noda | 24/170 |
| 4,670,945 | 6/1987 | Banks | 24/170 |

FOREIGN PATENT DOCUMENTS

| | | | |
|---|---|---|---|
| 2612033 | 10/1976 | Fed. Rep. of Germany | 24/197 |
| 1170404 | 9/1958 | France . | |
| 453257 | 1/1988 | Sweden . | |

*Primary Examiner*—Victor N. Sakran
*Attorney, Agent, or Firm*—Mattern, Ware, Stoltz & Fressola

[57] ABSTRACT

A separable buckle for interconnecting two parts of a strap or other tension member comprises a first buckle member adapted to be attached to the first strap part and a second buckle member adapted to be interconnected with the first buckle member and to slidably receive the second strap part. When interconnected, the two buckle members are relatively pivotable about a transverse axis with the first buckle member acting as a two-armed lever, one lever arm of which is engageable with the second strap part on the second buckle member so that the second strap part can move in one direction relative to the second buckle member but is prevented from moving in the opposite direction by said one lever arm. The second buckle member comprises a reverse bent hook portion including a hinge element receptive of a hinge element of the first buckle member.

13 Claims, 2 Drawing Sheets

SEPARABLE BUCKLE

BACKGROUND OF THE INVENTION:

1. Field of the Invention

This invention relates to a separable buckle for interconnecting two parts of a tension member, i.e. a belt, strap, cord, or other flexible element of substantially uniform thickness which is capable of taking tensile loads.

Buckles of this kind are used together with a strap or other tension member to form a strapping device which can be tightened around an object or objects by pulling a strap part running through the buckle. The strap can then be held in tightened condition by frictional self-locking action of the buckle on the strap. Because of the separability of the buckle members it is not necessary to pull the running strap part through the buckle all the way from or to a free end of the running strap part when the strapping device is to be applied to or removed from the object.

2. Prior Art:

An example of such strapping devices is disclosed in Swedish Patent No. 453,257 and takes the form of a so-called venostat (or tourniquet). A venostat is applied and tightened around the upper part of the arm of a patient when a blood sample is to be drawn from the bend of the patient's arm so that the veins are compressed and the blood flow through them is blocked. When blocking of the blood flow through the veins is no longer required, the venostat is released by separating the buckle members; because of the separability of the buckle members, there is no need for first widening the loop formed by the venostat and then sliding the venostat along the patient's arm.

Other examples of prior art separable buckles are disclosed in U.S. Pat. Nos. 3,496,305 and 3,566,454 and in French Patent No. 1,170,404.

SUMMARY OF THE INVENTION

An object of the invention is to provide a separable buckle which allows of quick and easy interconnection and separation of the buckle members Another object of the invention is to provide a simple and inexpensive separable buckle which is capable of securely holding together two parts of an associated strap or other elongated tension member and allows of quick and easy adjustment of the tension of the associated strap or other tension member.

A further object of the invention is to provide a strapping device, such as a venostat, comprising a simple and inexpensive separable buckle which allows of quick and easy fitting and release of the strapping device and which is capable of securely holding associated parts of the strap together in a selected tensioned condition of the strap.

The above and other objects are achieved with a separable buckle for interconnecting first and second parts of a strap or other tension member which buckle comprises interconnectable first and second buckle members. The first buckle member comprises a holding arm to which the first strap part is attached or attachable, a locking arm which is rigidly connected to the locking arm, and a first hinge element located between the holding arm and the locking arm. The second buckle member comprises a shank portion, a hook portion bent back from the shank portion, and a second hinge element on the hook portion. An end section of the hook portion overlying one side of the shank portion diverges from the shank portion. A slideway on which the second strap portion is slidable lengthwise is provided on the aforesaid side of the shank portion. The hinge elements are interconnectable to form a hinge having a hinge axis about which the first buckle member is pivotable as a two-armed lever relative to the second buckle member to move a free end of the locking arm into and out of engagement with the second strap portion on the slideway so as to lock that strap portion against lengthwise movement relative the slideway and thereby the shank portion.

The foregoing objects and features and advantages of the invention will be more fully understood from the following description with reference to the accompanying drawings.

DESCRIPTION OF THE PREFERRED EMBODIMENT

Figure 1:
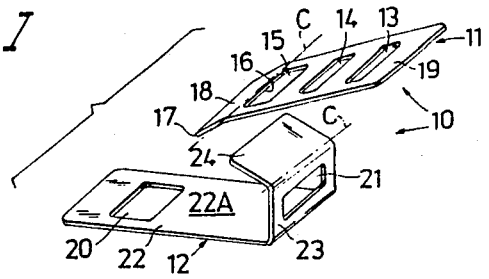
FIG. 1 is a perspective view of a buckle according to the invention with the two buckle members of the buckle shown separated.

As shown in the drawings, the buckle 10 comprises an elongated first buckle member 11 adapted to be attached to a first part of a tension member in the form of a strap, and a second buckle member 12, which is separably interconnectable with the first buckle member and adapted to receive a second part of the tension member in such a way that this second part can run through the second buckle member.

In use of the buckle 10 as illustrated in FIGS. 2–7, the tension member is a continuous, highly flexible strap A, one end portion of which forms the first part, hereinafter termed the fixed part, while the other portion of the strap forms the second part, hereinafter termed the running part. The strap A is made of textile material and is elastically extendable and compressible to some degree.

Each buckle member 11, 12 is formed of an elongated metal plate which is provided with rectangular cut-out openings and which is bent from flat rectangular sheet-metal blanks as described in greater detail hereinafter.

Figure 2:
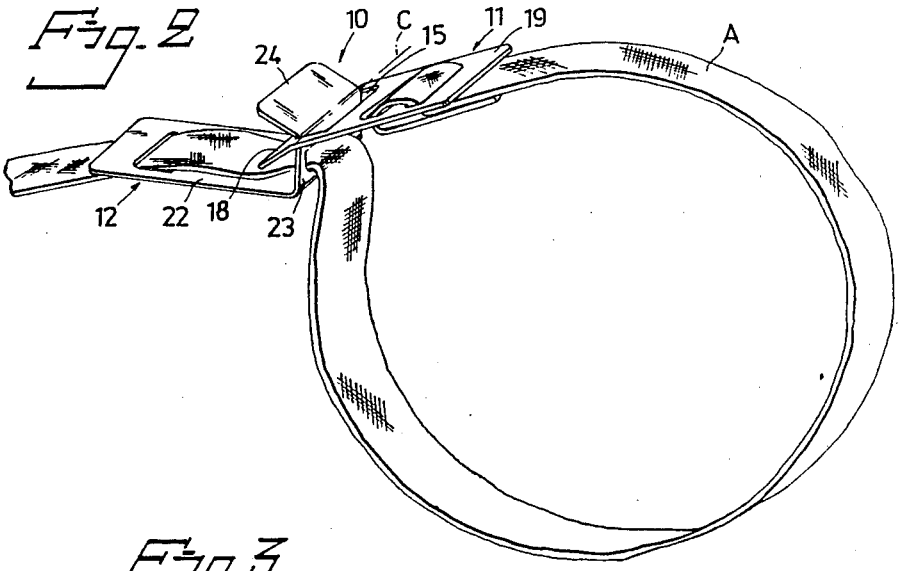
FIG. 2 is perspective view of a strapping device which is useful as a venostat and comprises the buckle of FIG. 1.
Figure 3:
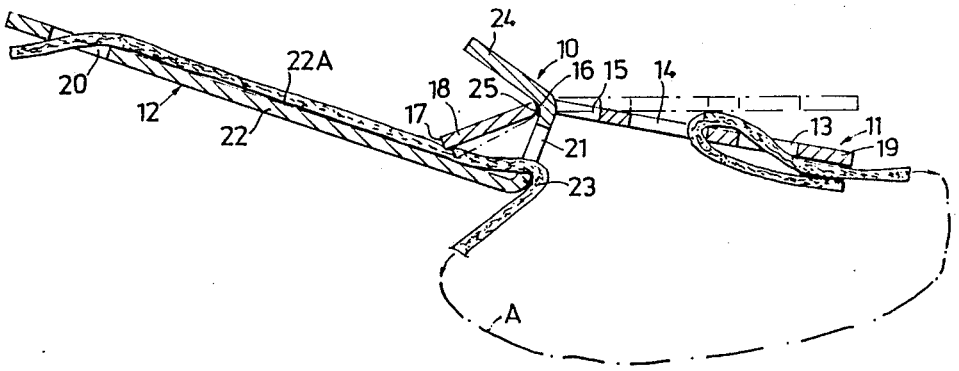
FIG. 3 is an enlarged longitudinal sectional view of the buckle of FIG. 2 and adjacent portions of the associated strap.

The first buckle member 11 is provided with three transversely extending elongated openings 13, 14 and 15, of which the openings 13 and 14 are used for attaching the fixed part of the strap A to the first buckle member as shown in FIGS. 2 and 3. The third opening 15 is adapted to receive a portion of the second buckle member 12. That edge 16 of the opening 15 which is remote from the openings 13 and 14 is parallel to the adjacent free or outer edge 17 of the first buckle member 11 and forms a first hinge element of the knife-edge type.

The portion of the first buckle member 11 which is positioned between the outer edge 17 and the edge 16 of the opening 15 forms a locking arm 18 which coacts with the running part of the strap A as described below. The portion of the first buckle member 11 which is positioned on the opposite side of the opening 15 from the locking arm 18 forms a holding arm 19 by which the fixed part of the strap A is attached to the first buckle member 11.

At or adjacent to the edge 16 of the opening 15, the first buckle member 11 is bent about a line parallel to that edge so that the locking arm 18 includes an obtuse angle with the holding arm 19. In the illustrated embodiment this angle is 150°-155°. The magnitude of the angle is not critical, but generally an angle Within the range of 130°-175° is preferred.

As shown in FIGS. 2 and 3, the free end of the fixed part of the strap A is passed from below (i.e. from the side of the first buckle member 11 having the aforementioned obtuse angle) through the opening 13 and then from above through the opening 14 and positioned flat against and secured to the underside of the portion of the fixed strap part which engages the underside of the holding arm 19.

The second buckle member 12 is provided with two openings 20 and 21 for receiving the running part of the strap A in such a way that this strap part is slidable lengthwise along the buckle member.

As seen in FIGS. 1-3, the second buckle member 12 is in the shape of a reversed horizontal J. It thus comprises a base or shank portion 22, which is provided with the opening 20 adjacent its outer or free end, and a reverse bent hook portion which overlies the shank portion 22 and includes an intermediate section 23, in which the opening 21 is provided, and an end section 24 extending from the intermediate portion over the shank portion 22.

The distance, as measured perpendicularly to the shank portion 22 between the shank portion 22 and the adjacent edge of the opening 21 in the intermediate section should be as large as possible.

The intermediate section 23 of the hook portion is substantially flat and is generally perpendicular to the shank portion 22, which is also flat. The end section 24, which merges smoothly with the intermediate section 23 through an arcuate transition 25, is also generally flat and diverges under an acute angle from the shank portion 22 in the direction away from the intermediate section 23.

In the illustrated embodiment, the angle included between the shank portion 22 and the end section 24 of the hook portion is about 17°. The width of the end section 24, i.e. its dimension as measured transversely of the length of the second buckle member 12 (parallel to the hinge axis C mentioned below), is slightly smaller than the corresponding dimension of the opening 15 in the first buckle member 11.

The inner side of the arcuate transition 25 between the intermediate section 23 of the hook portion and the end section 24 defines a trough-like hinge element which is complementary to the knife-edge hinge element formed by the opening edge 16 of the first buckle member 11. When the buckle members 11 and 12 are interconnected as shown in FIGS. 2 and 3 the two hinge elements 16 and 25 form a hinge the hinge axis C of which is parallel to the free edge 17 of the locking arm 18 and to that side, the upper side 22A, of the shank portion 22 which the hook portion 23/24 overlies.

When the buckle members 11 and 12 are interconnected in this way, they can thus pivot relative to one another about the hinge axis C so that the locking arm 18 of the first buckle member 11 is moved towards or away from the upper side side 22A of the shank portion 22 of the second buckle member 12. In this relative pivotal movement the outer or free edge 17 of the locking arm 18 is always parallel to the upper side 22A of the shank portion 22.

As shown in FIG. 3, the running part of the strap A is passed first through the opening 21 in the intermediate section 23 and then across the upper side 22A of the shank portion 22 and through the opening 20 in the latter. The openings 20 and 21 are sufficiently large to allow the strap A to run smoothly through them. The section of the upper side 22A of the shank portion 22 which extends between the openings 20 and 21 is smooth and forms a slideway for the running part of the strap A.

Preferably, the free end (not shown) of the running part of the strap A is provided with a shoe or other suitable means for preventing that strap end from becoming unintentionally retracted through the openings 20 and 21.

FIGS. 4-7 illustrate the use of the buckle 10 together with the strap A as explained below.

Figure 4:
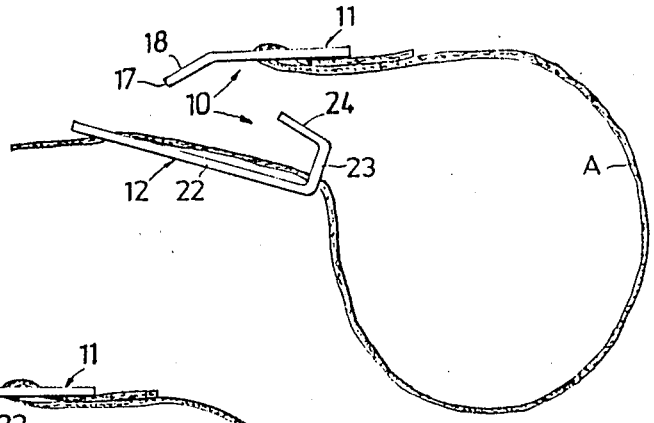
FIGS. 4–7 diagrammatic elevational views of the strapping device of FIGS. 2 and 3, FIG. 4 showing the strapping device being formed into a closed loop by interconnecting the buckle members, FIG. 5 showing tightening of the loop, FIG. 6 showing slackening of the loop and FIG. 7 showing opening of the loop by separating the buckle members.

In use of the strapping device, the strap A with the separated buckle members 11 and 12 is applied around the object or objects to be strapped, FIG. 4, and the hook portion 23/24 of the second buckle member 12 is inserted in the opening 15 of the first buckle member 11, so that the buckle members become interconnected as shown in FIGS. 2 and 3. The strap A is then tightened by pulling the running part thereof.

Figure 5:
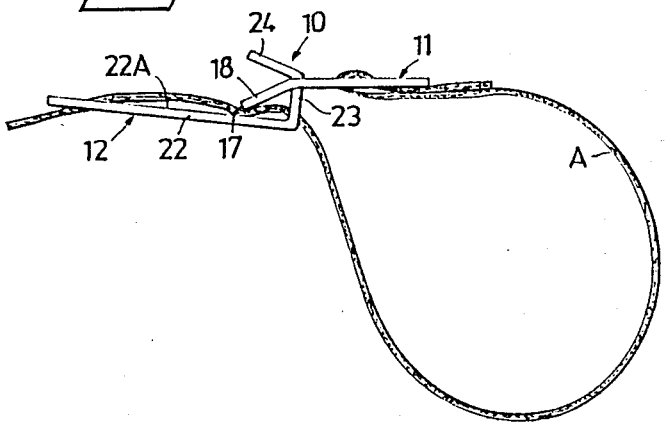

When the pulling of the running part ceases, this strap part is locked against the buckle member 12 by frictional self-locking action of the locking arm 18 against the strap (FIG. 5). The tension in the looped portion of the strap A tends to retract the running strap part through the second buckle member 12, but the friction of the strap against the outer edge 17 of the locking arm 18 causes the locking arm to press the strap firmly against the upper face 22A of the shank portion 22; the pressing force increases with increasing tension in the strap. Because the fixed part of the strap A is positioned below the free end of the holding arm 19 and the holding arm includes an angle with the locking arm 18 as illustrated and described above, the locking action which the locking arm 18 exerts on the strap A is augmented.

Figure 6:
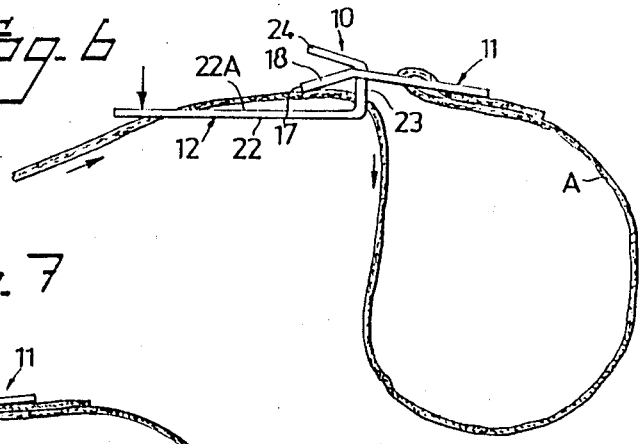

The looped portion of the strap A may be slackened by downward finger pressure against the free end of the shank portion 22 as shown in FIG. 6. The second buckle member 12 will then be pivoted counterclockwise relative to the first buckle member 11 such that the pressure of the locking arm 18 against the strap is relieved and the strap A may slide backwards.

Figure 7:
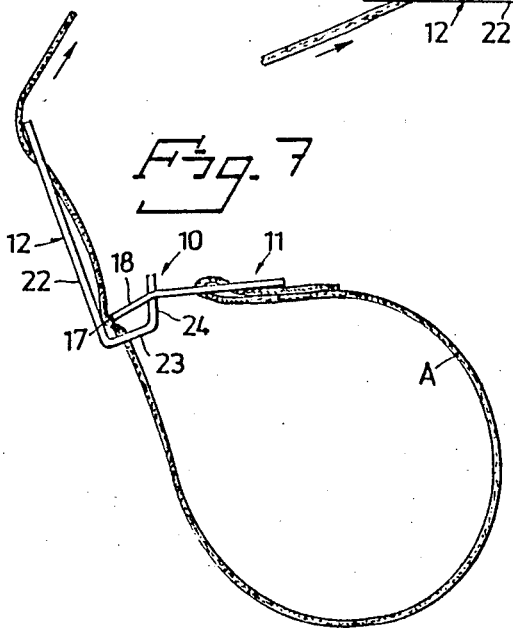

The strapping may be released by pulling the free portion of the running strap part upwardly as shown in FIG. 7 or by otherwise lifting the free end of the shank portion 22 of the second buckle member 12 such that the second buckle member 12 is pivoted counterclockwise relative to the first buckle member 11. The locking arm 18 of the first buckle member 11 will then compress the strap A against the shank portion 22 sufficiently to permit the buckle members to pivot relative to one another about the free edge 17 of the locking arm 18 so that the hinge element (edge 16) of the first buckle member 11 slides towards the free end of the end section 2 of the hook portion.

In order that the buckle 10 may function in as satisfactory a manner as possible, certain dimensions of the buckle members 11 and 12 should be matched with one another and with the thickness and properties of the strap A.

Thus, the length of the locking arm 18 of the first buckle member 11, i.e., the distance between the outer or free edge 17 and the edge 16 of the opening 15, should be chosen such that the locking arm 18 in its locking position (FIG. 3) includes a suitable acute angle with the shank portion 22 of the second buckle member 12. In most cases, the length should be such that the angle included between the locking arm 18 and the shank portion 22 is between 40° and 80° when the first buckle member 11 is pivoted to a position in which the free edge 17 of the locking arm 18 engages the upper side 22A of the shank portion 22 as shown in phantom lines in FIG. 3. If the angle is chosen to be within the central half of this range, e.g. between 55° and 70°, both a reliable locking action and an easy separation of the buckle 10 may be achieved when using one and the same buckle with straps which vary widely in respect of their thickness and compressibility.

Alternatively, or in addition, it may be suitable to choose the length of the locking arm 18 to be between 1.0 and 1.3, preferably between 1.1 and 1.2, times the distance, as measured perpendicularly to the shank portion 22, between the upper side 22A of the shank portion 22 and the transition 25 (hinge axis C) between the intermediate and end sections 23, 24 of the hook portion. This relative dimensioning of the locking arm 18 also provides for a reliable locking of the strap and an easy separation of the buckle 10 when using the buckle with straps differing substantially from one another in respect of their thickness and compressibility.

The interconnection and separation of the buckle 10 may be effected in a particularly simple and easy manner if the distance between the shank portion 22 and the end section 24 of the hook portion is matched with the length of the locking arm 18 both at the transition 25 (hinge axis C) between the intermediate section 23 and the end section 24 and at the free end of the end section 24. At the first-mentioned location that distance, again as measured perpendicularly to the shank portion 22, should be shorter than the length of the locking arm 18, and at the last mentioned location the corresponding distance should be longer than, preferably 1.1 to 1.3 times, the length of the locking arm 18.

The angle under which the end section 24 of the hook portion diverges from the shank portion 22 preferably is within the range of 1.5° to 25°. Preferably also, the length of the end section 24 is approximately equal to the length of the locking arm 18.

The function of the buckle is not dependent on the tension member being elastic and/or compressible. If the tension member is incompressible or only slightly compressible under action of the force applied by the locking arm 18, the operation when separating the buckle members will be slightly different from that described above with reference to FIG. 7. In such case, when separating the buckle by lifting the shank portion 22 as described, the outer end of the locking arm 18 will initially be displaced relative to the shank portion 22 towards the free end of the latter, and at the same time the edge 16 will slide along the inner side of the end section 24 of the hook portion towards the outer end of the end section. This movement will continue until the the buckle members can pivot relative to one another about the outer edge 17 of the locking arm 18 as described above with reference to FIG. 7.

When using the buckle 10 with certain types of straps, e.g. soft and relatively thick textile straps, it may be advantageous to pass the fixed part of the strap through that opening in the first buckle member 11 which serves to receive the hook portion 23/24 of the second buckle member 12, i.e., the opening 15. Apart from the omission of one opening in the first buckle member 11 which is then possible, suitable dimensioning of the opening 15 may make possible a certain "deadening" of the sudden relative movement which takes place upon separation of the buckle with the strap tensioned, because that portion of the strap which is received in the opening 15 frictionally engages the end section 24 of the hook portion of the second buckle member 12. Such attachment of the first buckle member 11 to the strap also reduces the danger of the buckle members 11 and 12 coming into metal-to metal engagement with one another and thus causing noise.

What I claim is:

1. A separable buckle for interconnecting two parts of an elongated tension member, such as a strap, comprising (a) a first buckle member having first and second ends and comprising
- a holding arm including said first end,
- means on said holding arm for attaching one of said tension member parts to it,
- a locking arm rigidly connected with said holding arm remote from said first end, said locking arm including said second end, and
- a first hinge element located between said holding arm and said locking arm, and (b) a second buckle member comprising
- a shank portion having on one side thereof a slideway on which the other tension member part is receivable and slidable lengthwise,
- a hook portion which is bent back from one end of said shank portion to overlie said one side thereof and comprises an end section and an intermediate section joining said end section and said shank portion, said end section diverging from said shank portion in the direction away from said intermediate section,
- a second hinge element on said hook portion, said second hinge element being interconnectable with said first hinge element so as to form together therewith a separable hinge by which said first and second buckle members are pivotally interconnected, said hinge having a hinge axis about which said first buckle member is pivotable as a two-armed lever to move said second end towards and away from said slideway.

2. A buckle according to claim 1 in which in the interconnected condition of the hinge elements with the first buckle member pivoted to a position in which said second end thereof engages the slideway, the locking arm includes an angle of between 45° and 80° with the slideway.

3. A buckle according to claim 1 in which the distance between said second end of said first buckle member and said first hinge element is between 1.0 and 1.3 times the perpendicular distance between said slideway and said second hinge axis.

4. A buckle member according to claim 1 in which the distance between said second end and said hinge element of said first buckle member is greater than the perpendicular distance between said slideway and said hinge element of said second buckle member and shorter than the perpendicular distance between said slideway and the end of said end section remote from said intermediate section.

5. A buckle according to claim 1 in which said second buckle member is provided in said intermediate section of said hook portion with an opening for the passage of said other tension member part.

6. A buckle according to claim 5 in which said opening in said intermediate section is spaced from said shank portion, said second hinge element being provided at the side of said opening in said intermediate section which is remote from said shank portion.

7. A buckle according to claim 6 in which said second buckle member is provided with a second opening for the passage of said other tension member part, said second opening being separated from said hook portion by said slideway.

8. A buckle according to claim 1 in which said first buckle member is a plate member provided with an opening which is receptive of said hook portion of said second buckle member and which is partly defined by a straight edge portion constituting said hinge element of said first buckle member.

9. A buckle according to claim 8 in which said plate member is bent about a line adjacent to or coinciding with said edge portion of said first buckle member, the angle included between said holding arm and said locking arm being 135°–175°.

10. A buckle according to claim 8 in which said second buckle member is a plate member bent substantially to the shape of the letter J.

11. A strapping device comprising:

A. an elongated tension member such as a strap; and

B. a separable buckle for interconnecting two parts of said elongated tension member comprising:

(i) a first buckle member to which an end portion of said elongated tension member is attached, and comprising first and second ends, a holding arm including said first end, means on said holding arm for attaching one of said tension member parts to it, a locking arm rigidly connected with said holding arm remote from said first end, said locking arm including said second end, and a first hinge element located between said holding arm and said locking arm, and (ii) a second buckle member, which is separably interconnectable with said first buckle member and through which the tension member extends slidably in the direction of its length, and comprising a shank portion having on one side thereof a slideway on which the other tension member part is receivable and slidable lengthwise, a hook portion which is bent back from one end of said shank portion to overlie said one side thereof and comprises an end section and an intermediate section joining said end section and said shank portion, said end section diverging from said shank portion in the direction away from said intermediate section, a second hinge element on said hook portion, said second hinge element being interconnectable with said first hinge element so as to form together therewith a separable hinge b y which said first and second buckle members are pivotally interconnected, said hinge having a hinge axis about which said first buckle member is pivotable as a two-armed lever to move said second end towards and away from said slideway.

12. A buckle according to claim 11 in which said first buckle member is a plate member provided with an opening which is receptive of said hook portion of said second buckle member and which is partly defined by a straight edge portion constituting said hinge element of said first buckle member.

13. A buckle according to claim 12 in which said second buckle member is a plate member bent substantially to the shape of the letter J.

* * * * *